United States Patent [19]

Quiogue

[11] Patent Number: 4,507,719

[45] Date of Patent: Mar. 26, 1985

[54] HEAT DISSIPATOR FOR PLASTIC LUMINAIRE

[75] Inventor: Honesto D. Quiogue, Blacksburg, Va.

[73] Assignee: Harvey Hubbell Incorporated, Orange, Conn.

[21] Appl. No.: 552,619

[22] Filed: Nov. 17, 1983

[51] Int. Cl.[3] ..... F21S 1/04

[52] U.S. Cl. ..... 362/404; 362/147; 362/218; 362/294; 362/368; 362/373; 362/388

[58] Field of Search ..... 362/404, 218, 147, 294, 362/368, 373, 388

[56] References Cited

U.S. PATENT DOCUMENTS

| | | | |
|---|---|---|---|
| D. 98,924 | 3/1936 | Fassin . | |
| 4,054,790 | 10/1977 | Slaughter | 240/11.2 |
| 4,104,713 | 8/1978 | Chan et al. | 362/294 |
| 4,234,916 | 11/1980 | Goralnik | 362/294 |
| 4,302,798 | 11/1981 | Sit | 362/294 |

OTHER PUBLICATIONS

Prescolite brochure of Trimline drums; 1981, (p. 38).

*Primary Examiner*—Stephen J. Lechert, Jr.
*Attorney, Agent, or Firm*—Jerry M. Presson; Walter C. Farley

[57] ABSTRACT

A luminaire housing is made exclusively or almost entirely of plastic material and contains an HID lamp together with its ballast and other components. A shallow, thermally conductive heat dissipating pan is mounted against the back of the housing and receives a body of fibrous insulating material, the pan being connected by a highly heat conductive member to the lamp reflector and a heat conductive support bracket within the housing to convey heat from the housing to the pan for dissipation to the ambient atmosphere.

3 Claims, 5 Drawing Figures

HEAT DISSIPATOR FOR PLASTIC LUMINAIRE

SPECIFICATION

This invention relates to a luminaire of the type having a relatively small housing formed almost entirely of polymeric material, and particularly to an improved structure for removing and dissipating heat from the interior of the luminaire housing.

BACKGROUND OF THE INVENTION

Certain types of lighting fixtures are designed to be mounted directly adjacent a ceiling or wall and are typically made with a rather small housing. The word "small", of course, is a relative term; but in this context it refers to a luminaire which is capable of containing a relatively large lamp, such as a high intensity discharge lamp or a fluorescent tube, and in which the housing is not large as compared with the lamp.

Another characteristic of a fixture of this type which is significant is that the fixture is made to "hug" the wall or ceiling against which it is mounted, presenting a relatively unobtrusive, and yet attractive, appearance.

If such a fixture is to be made using a high intensity discharge (HID) lamp, which requires the use of a ballast or transformer and other circuit components, a considerable amount of heat is generated within the housing by the lamp itself and also by the ballast. Conventionally, a fixture of this type is constructed using a metal housing, often with a glass refractor, the metal housing being capable of dissipating the heat generated by the lamp and ballast so that the temperature does not become excessive. It is, however, desirable to be able to make the housing entirely of polymeric material because such material is less expensive to fabricate in large quantities and because the use of molded polymeric materials permits wider variety in the choice of designs and configurations which can be used to accommodate a wide variety of decorating schemes, and to be able to make the housing substantially closed to keep out dirt.

BRIEF SUMMARY OF THE INVENTION

Accordingly, an object of the present invention is to provide a luminaire structure in which the housing can be formed entirely of a polymeric, plastic material and which has provision for dissipating the heat generated by a lamp and other electrical components contained within the housing.

Briefly described, the invention comprises a heat dissipating structure for a luminaire of the type having a housing of polymeric material with a back wall intended to be mounted adjacent a wall or ceiling mounting surface with an open side facing away from the surface, a translucent refractor covering the open side, heat generating electrical circuit means including a lamp within the housing and a reflector between the housing and the lamp. The heat dissipating structure itself comprises a number of openings through the back wall, a radiator pan including a shallow metal pan having a first wall in contiguous parallel relationship with the back wall of the housing and four relatively short side walls extending away from the housing, and means defining openings in the first wall of the pan in register with the openings through the back wall. The heat dissipating structure also includes a body of heat insulating material in the pan and fastener means extending through the back wall of the housing, the reflector and the pan to couple these heat conductive components to the pan with the open side of the pan toward the mounting surface.

Further in accordance with the invention, the reflector is made of a very good heat conducting material and is coupled by fastener means to the pan providing a good heat conduction path. Additionally, the electrical circuit means within the housing is mounted on a thermally, conductive metal bracket which is attached to the fastener means, providing a further heat-conductive path from the interior of the housing to the pan.

In order that the manner in which the foregoing and other objects are attained in accordance with the invention can be understood in detail, particularly advantageous embodiments thereof will be described with reference to the accompanying drawings, which form a part of this specification, and wherein.

Detailed Description of the Drawings

Figure 1:
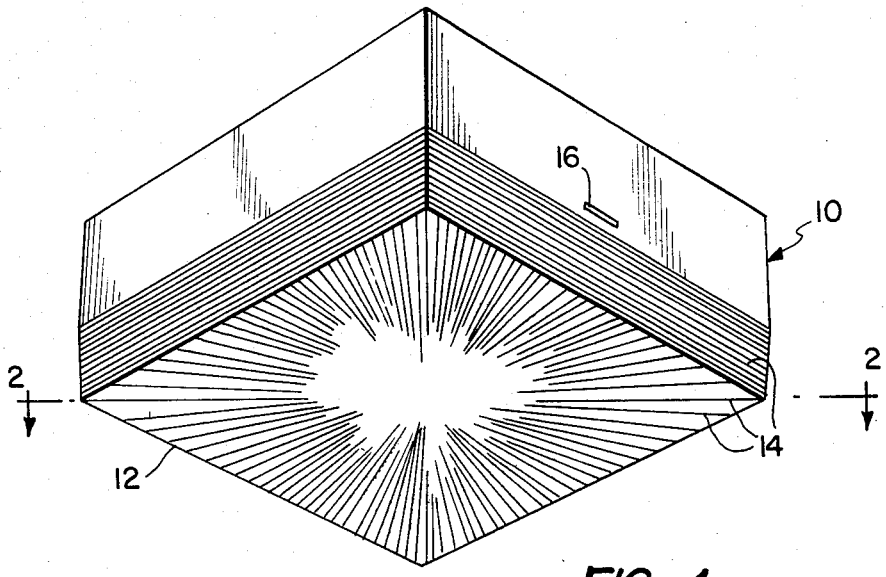
FIG. 1 is a perspective view of a luminaire of the type to which the invention relates.

Referring first to FIG. 1, a luminaire which will be used as the basic example for application of the techniques of the present invention includes a housing 10 which is rectangular and which is made of a molded polymeric material, and a refractor 12 which is also made of a polymeric material, the housing 10 being opaque and the refractor being made of a transparent polycarbonate or the like. The surfaces of the refractor can be provided with ribs 14 or the like on its various surfaces to direct light in any desired fashion, and the housing can be provided with a latch means available through an opening 16 to permit removal of the refractor for access to the lamp and other circuit components within the housing.

Figure 2:
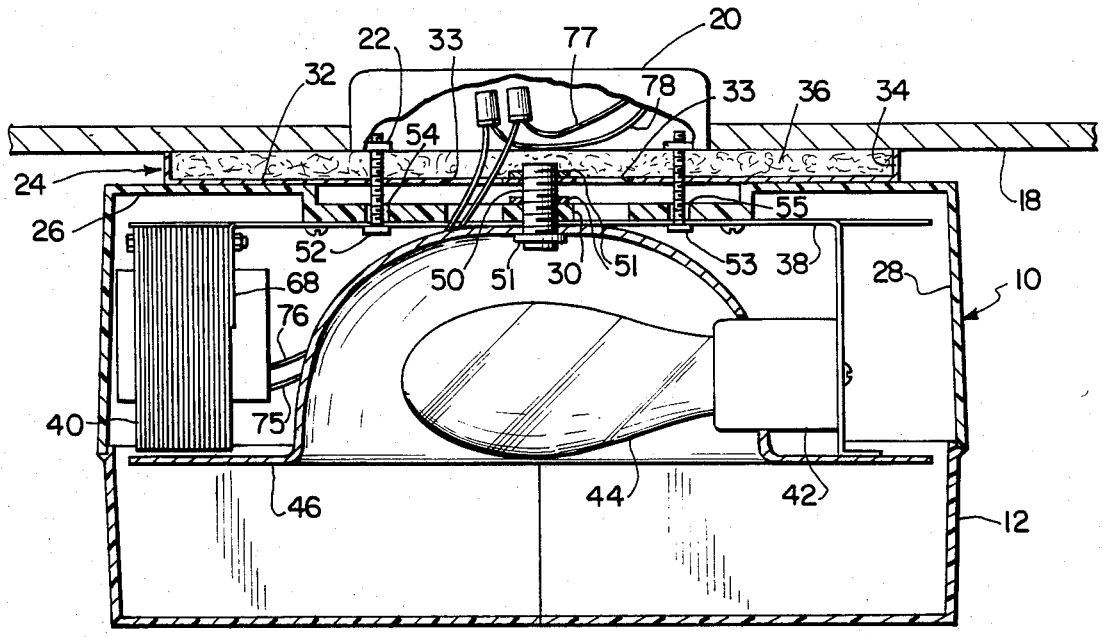
FIG. 2 is a side elevation, in partial section, along line 2—2 of FIG. 1 showing the luminaire of FIG. 1 attached to a mounting surface.

These components are further illustrated in FIG. 2 mounted adjacent a mounting surface such as a ceiling panel 18. As shown therein, the ceiling panel can have a conventional junction box 20 having mounting ears 22 or other conventional mounting means on which the luminaire is supported. The housing 10 is spaced from the exposed surface of panel 18 by a relatively small distance which approximates the thickness of a radiator pan 24.

The housing itself includes a back wall 26 and a plurality of side walls 28, all made of polymeric material, the back wall having openings 30 therethrough. Pan 24 has a major surface 32 in contiguous parallel relationship with back wall 26 and also has openings 33 which are shaped and positioned so as to be substantially aligned with openings 30. Pan 24 also has peripheral, relatively short walls 34 extending away from back wall 26, and contains a pad of insulating material 36 such as fiberglass. Pan 24 is formed from a very good heat conducting metal such as aluminum having a thickness on the order of 0.062 inches.

Returning to the interior of housing 5, it will be seen that the housing contains a bracket 38 which is also made of a good heat conducting material such as aluminum, the bracket being formed to support electrical components within the housing including a ballast 40, a lamp socket 42 which receives a lamp 44, and such other electrical components as are required for proper operation of the lamp. A reflector 46 is also contained within the housing and is made, as is the bracket, of a good heat conducting material such as aluminum, the inner reflective surface thereof being treated in a conventional manner so as to be highly reflective.

The reflector 46, bracket 38 and radiator pan 24 are firmly interconnected with each other by an externally threaded nipple 50 which passes through central openings in these members and is attached thereto by nuts 51, the nuts also holding the bracket and reflector to back wall 26 of housing 10. In addition, fasteners 52 and 53 extend through arcuate openings 54 and 55 in bracket 38 and wall 26 and also through similar openings in pan 24 and extend into mounting ears 22 in box 20. Fasteners 52 and 53, which can be conventional machine screws, thus form the primary support for the fixture. Of particular significance in the interconnection and support system is the provision of the relatively massive interconnection of the reflector, bracket and radiator pan by nipple 50 which is made of a highly thermally conductive material such as brass and which forms a fastener means thermally coupling these components.

Figure 3:
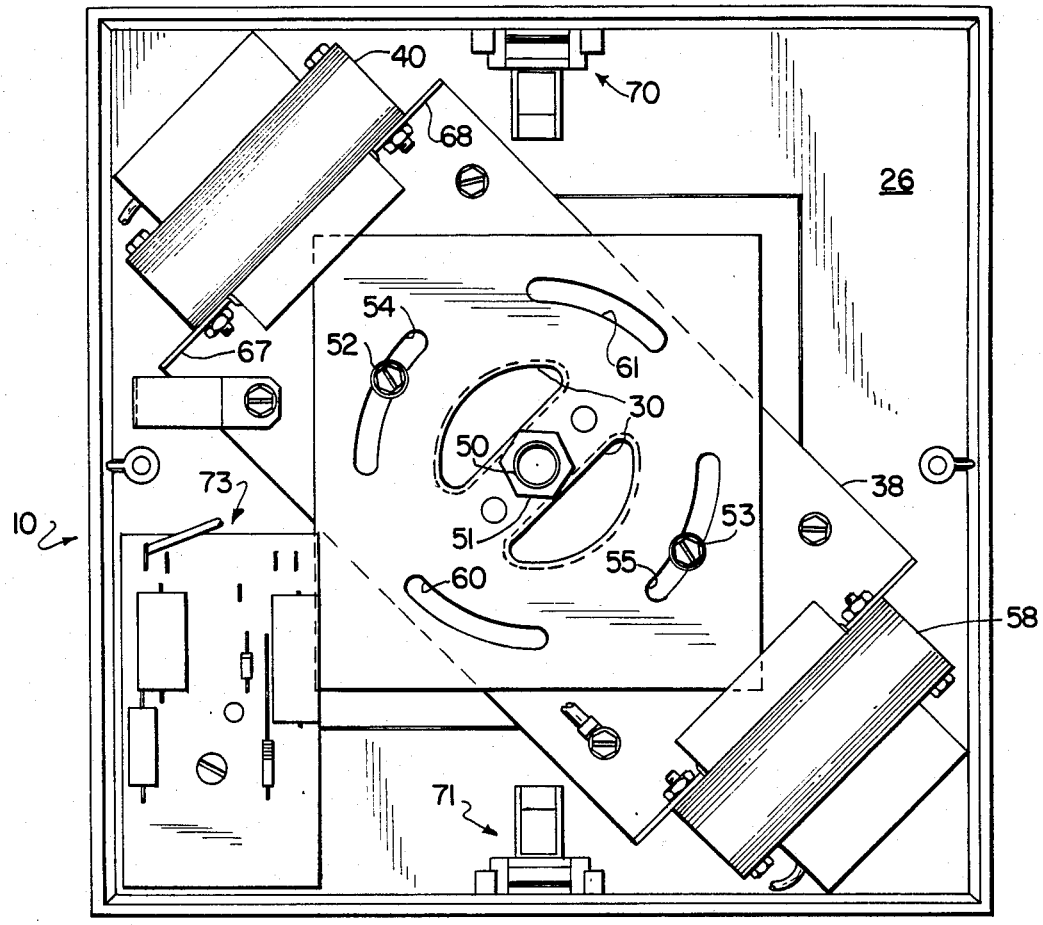
FIG. 3 is a bottom plan view of a modified embodiment of a luminaire in accordance with the invention with the lamp and reflector removed.
Figure 4:
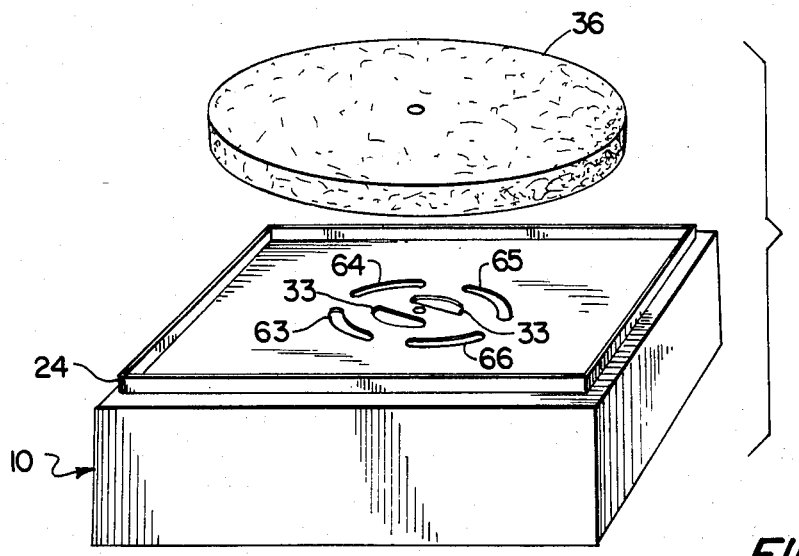
FIG. 4 is a partially exploded perspective view of a luminaire housing in accordance with the invention.

Referring to FIGS. 3 and 4, FIG. 3 shows an embodiment which is somewhat similar to FIG. 2 but which, in addition to ballast 40, includes a ballast 58. Otherwise, the structure of the embodiment of FIG. 3 is identical to that of FIG. 2 and the various components are given the same numbers. It will be observed in both FIGS. 3 and 4 that openings 30 are somewhat semicircular along their outer edges but the inner edges are parallel, forming a bridge through which nipple 50 can pass. It will also be observed that openings 54 and 55 are elongated arcuate openings and that plate 38 is further provided with elongated arcuate openings 60 and 61 which lie on essentially the same circle. Furthermore, wall 26 of housing 10 and wall 32 of pan 24 are provided with arcuate openings having substantially the same size and shape and circular orientation as openings 54, 55, 60 and 61 to provide vent passages as will be described. The openings in vent pan 24 are identified as 63, 64, 65, and 66 with central openings 33 being aligned with openings 30.

As will be recognized from FIGS. 2 and 3, bracket 38 includes end cut-outs to receive protruding portions of ballast 40 or ballasts 40 and 58, leaving bent-down portions 67, 68 to be attached to the ballast. These bent-down portions are attached to the stacks of laminations of the ballasts in good heat conducting relationship therewith. Thus, heat is conveyed through bracket 38 to the vicinity of nipple 50.

As seen in FIG. 3, the housing structure also includes such features as latches indicated generally at 70 and 71 for retaining the refractor and a printed circuit board indicated generally at 73 which can hold circuit elements needed to operate the lamp. However, these are not directly part of the present invention and will not be described in further detail.

Finally, electrical wires 75, 76 extend from the ballast and other circuit components through openings 30 and 33 and into junction box 20 where they are connected as by conventional wire nuts, to other wires 77, 78 which lead to a source of power.

When the lamp is operating both the ballast and the lamp generate a considerable amount of heat, as previously indicated. The volume of air within the luminaire housing expands and carries this heat to the surrounding walls. The housing and refractor, which are made out of plastic materials, retard the transfer of heat from the interior volume of the housing to the ambient atmosphere, but the provision of the other heat conducting portions of the system nevertheless convey heat away so that sufficient cooling occurs. The heat generated by the ballast as a result of current passing through its windings is absorbed by the laminations of the ballast and is transferred to the mounting bracket as previously described. This non-ferrous bracket conducts heat toward the center of the bracket and through the tubular nipple connecting the mounting bracket with the radiator pan where the heat is distributed and radiated by the pan to the surrounding air.

By convection, the hot air heated by the lamp is absorbed by the aluminum reflector which, in a similar fashion, conveys this heat to nipple 50 and to pan 24. Between the back of the reflector and the top of the housing the heated air rises and escapes through the openings therein, which heat is kept from travelling to the mounting surface 18 by the layer of insulation 36, forcing the heat to be absorbed by pan 24 and again transferred to the air. Pan 24 radiates as well as conducts heat to the surrounding environment.

By this combination of techniques it is made possible to use thermoplastic material as a housing and refractor and to make the housing as compact as possible even using a high intensity discharge lamp source. It will be observed from the figures that there is relatively little volume within housing 10 which is not occupied by some electrical component consistent with the shape of the housing itself, demonstrating that the compact nature of the housing is maintained to a considerable degree.

Figure 5:
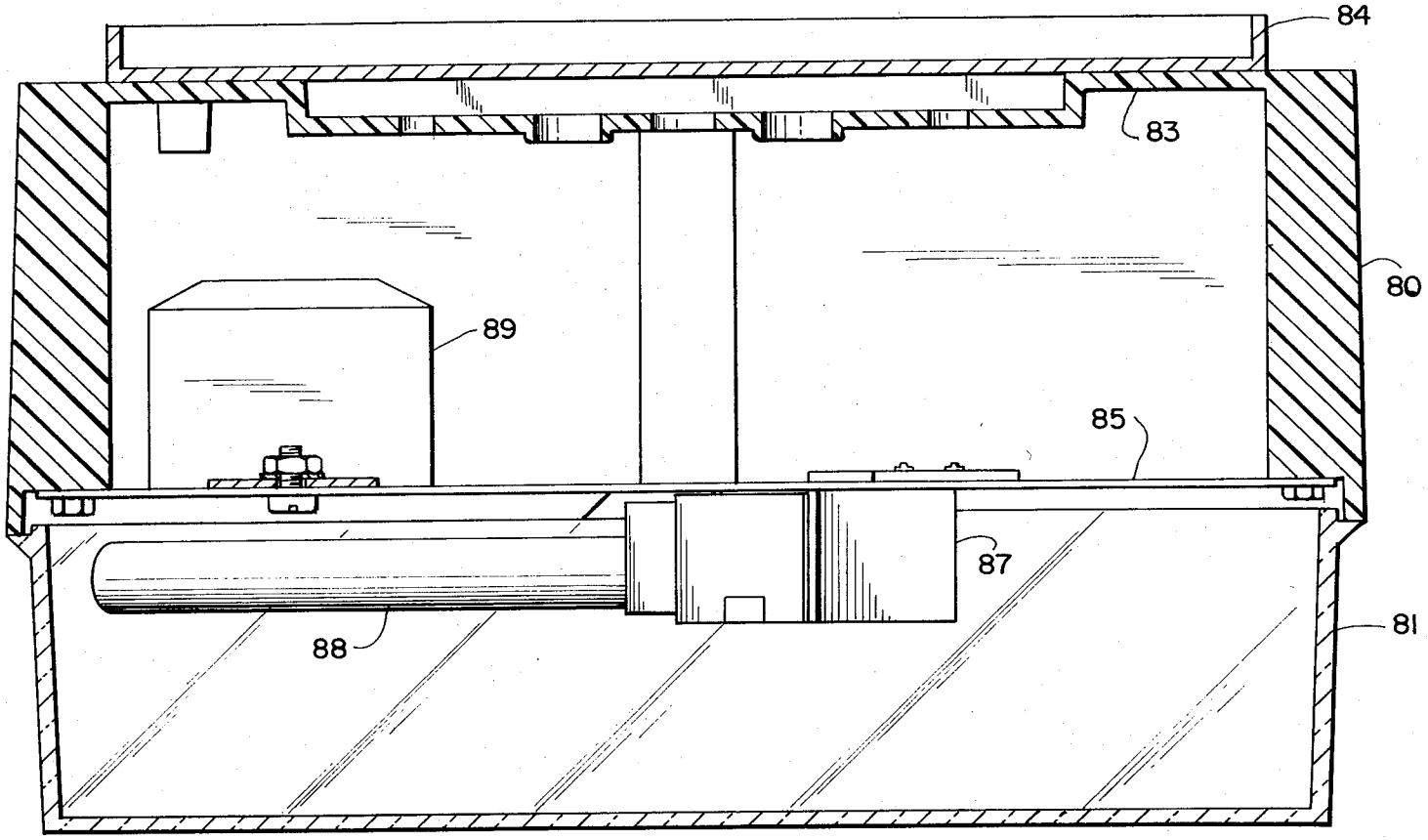
FIG. 5 is a side elevation, in section, of yet another embodiment of a luminaire in accordance with the invention.

FIG. 5 shows a further embodiment of a structure in accordance with the invention in which a fluorescent tube is used. Multiple fluorescent tubes can also be employed, but only one is illustrated in the embodiment of FIG. 5.

As shown therein, a housing 80 has a refractor 81, the housing having a back wall 83 which is attachable to a radiator pan 84 which is substantially identical to pan 24 of the embodiment of FIGS. 2–4. A mounting plate 85 extends across the open side of housing 80 to support a tube socket 87 which receives a fluorescent tube 88. A relatively large cavity is formed between plate 85 and wall 83, this cavity being capable of receiving a starter unit 89 or other components needed to operate the lamp. Fasteners and other details of the structure have been omitted from FIG. 5 for simplicity of illustration.

As will be recognized, the use of a fluorescent tube requires less in the way of heat dissipation than does the use of an HID lamp. However, the purpose of including FIG. 5 is to demonstrate that a housing of similar configuration and made of similar materials can be employed for the purpose of supporting fixtures of various kinds, the fluorescent lamp or multiple fluorescent lamps being used as an example. It will also be recognized that the circuitry 89 for such a lamp involves heat which must be dissipated, although not to the same extent. The housing can, of course, have different shapes.

While certain advantageous embodiments have been chosen to illustrate the invention, it will be understood by those skilled in the art that various changes and modifications can be made therein without departing from the scope of the invention as defined in the appended claims.

What is claimed is:

1. A heat dissipation structure for a lighting fixture of the type having a housing of polymeric material with a back wall intended to be mounted adjacent a wall or ceiling mounting surface with an open side facing away from the surface, a translucent refractor covering the open side of the housing, heat generating electrical circuit means including a lamp within the housing and a reflector between the housing and the lamp, the heat dissipating structure comprising means defining openings through said back wall;

a radiator pan comprising a shallow metal pan having a first wall in contiguous parallel relationship with said back wall of said housing and four relatively short side walls extending away from said housing;

means defining openings in said first wall of said pan in register with said openings through said back wall;

a body of heat insulating material in said pan;

fastener means extending through said back wall of said housing, said pan and said insulating material to hold the open side of said pan adjacent said mounting surface; and heat conducting means interconnecting said reflector and said pan for conducting heat to said pan for dissipation to the surrounding atmosphere.

2. A structure according to claim 1 and further comprising thermally conductive metal bracket thermally connected to said pan, said bracket having means for supporting said heat-generating electrical circuit means.

3. A structure according to claim 2 wherein said heat conducting means comprises a tubular externally threaded metal nipple and a plurality of nuts firmly coupling said pan, said bracket and said reflector to each other in good heat conducting relationship.

* * * * *